US010913302B2

(12) United States Patent
Fukunaga

(10) Patent No.: US 10,913,302 B2
(45) Date of Patent: Feb. 9, 2021

(54) THERMAL TRANSFER RECORDING MEDIUM

(71) Applicant: TOPPAN PRINTING CO., LTD., Tokyo (JP)

(72) Inventor: Godai Fukunaga, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 16/597,631

(22) Filed: Oct. 9, 2019

(65) Prior Publication Data

US 2020/0039272 A1 Feb. 6, 2020

Related U.S. Application Data

(63) Continuation of application No. PCT/JP2018/015558, filed on Apr. 13, 2018.

(30) Foreign Application Priority Data

Apr. 13, 2017 (JP) ..... 2017-080035

(51) Int. Cl.
*B41J 2/335* (2006.01)
*B41M 5/385* (2006.01)

(52) U.S. Cl.
CPC ..... *B41M 5/385* (2013.01)

(58) Field of Classification Search
CPC .... B41J 2/33505; B41J 2/33515; B41M 5/44; B41M 5/385; B41M 5/3852; B41M 5/3858; B41M 5/395; B41M 2205/36; B41M 2205/38; B41M 2205/28; B41M 2205/30; B41M 5/39; B41M 2205/02; B41M 2205/06
See application file for complete search history.

(56) References Cited

U.S. PATENT DOCUMENTS 9,387,714 B2 * 7/2016 Sugiyama ..... B41M 5/34
2007/0032381 A1 * 2/2007 Nagasaki ..... B41M 5/423 503/226
2009/0165938 A1 * 7/2009 Muro ..... B41M 5/42 156/230

FOREIGN PATENT DOCUMENTS

JP 2005-280136 A 10/2005
JP 2013-146876 A 8/2013
JP 2013-202846 A 10/2013

OTHER PUBLICATIONS

International Searching Authority, "International Search Report," issued in connection with International Patent Application No. PCT/JP2018/015558, dated May 22, 2018.

(Continued)

*Primary Examiner* — Kristal Feggins
(74) *Attorney, Agent, or Firm* — Foley & Lardner LLP

(57) ABSTRACT

A thermal transfer recording medium comprises a heat-resistant lubricating layer laminated on a first surface of a substrate, and an undercoat layer and a dye layer laminated in this order on a second surface of the substrate. The dye layer contains, as binders, a polyvinyl acetal resin, a phenoxy resin, and a graft copolymer having a main chain comprising polycarbonate and a side chain comprising a vinyl-based polymer, and also contains Compounds I, II, and III as cyan dyes.

2 Claims, 1 Drawing Sheet

(56) References Cited

OTHER PUBLICATIONS

International Searching Authority, "Written Opinion," issued in connection with International Patent Application No. PCT/JP2018/015558, dated May 22, 2018.
The State Intellectual Property Office of China, "Office Action," issued in connection with Chinese Patent Application No. 201880024021.3, dated Dec. 1, 2020.

* cited by examiner

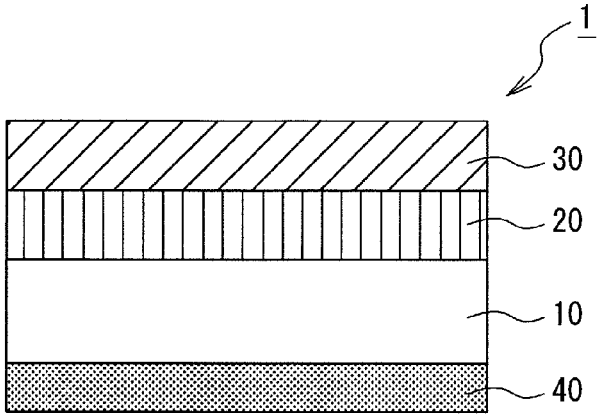
1
30
20
10
40

THERMAL TRANSFER RECORDING MEDIUM

CROSS-REFERENCE TO RELATED PATENT APPLICATIONS

This application is a continuation application filed under 35 U.S.C. § 111(a) claiming the benefit under 35 U.S.C. §§ 120 and 365(c) of International Patent Application No. PCT/JP2018/015558, filed on Apr. 13, 2018, which is based upon and claims the benefit of priority to and to Japanese Patent Application No. 2017-080035, filed on Apr. 13, 2017; the disclosures of which are all incorporated herein by reference in their entireties.

TECHNICAL FIELD

The present invention relates to a thermal transfer recording medium.

BACKGROUND ART

Thermal transfer recording media are generally called thermal ribbons and are used, for example, for ink ribbons of thermal transfer printers. Conventional thermal transfer recording media are disclosed, for example, in PTL 1 and PTL 2. PTL 1 and PTL 2 each disclose a thermal transfer recording medium comprising a thermal transfer layer on one surface of a substrate, and a heat-resistant lubricating layer (a back coat layer) on the other surface of the substrate. Here, the thermal transfer layer comprises a layer containing ink (a dye layer), from which the ink is sublimated (sublimation transfer printing) or melted (melt transfer printing) by the heat generated by the thermal head of the printer, and transferred to a transfer object.

For thermal transfer recording media, there are various demands, such as higher thermal transfer printing speed, and high density and high quality of thermal transfer images. On the other hand, there is also a high demand for cost reduction, with the spread of thermal transfer printers. Increases in the thermal transfer printing speed caused a problem that sufficient printing density was not obtained by conventional thermal transfer recording media. Accordingly, in order to increase transfer sensitivity, attempts have been made to improve printing density and transfer sensitivity in printing by increasing the ratio of dye to resin (dye/binder) in the dye layer; however, an increase in the dye causes not only cost increase, but also problems such as the occurrence of dye precipitation and scumming.

[Citation List] [Patent Literature] PTL 1: JP 2013-146876 A; PTL 2: JP 2013-202846 A.

SUMMARY OF THE INVENTION

Technical Problem

An object of the present invention is to provide a thermal transfer recording medium that has high dye transfer sensitivity and that is resistant to the occurrence of dye precipitation and scumming (i.e., having good storage stability).

Solution to Problem

The summary of the thermal transfer recording medium according to one embodiment of the present invention is that it comprises a heat-resistant lubricating layer laminated on a first surface of a substrate, and an undercoat layer and a dye layer laminated in this order on a second surface of the substrate, wherein the dye layer contains, as binders, a polyvinyl acetal resin, a phenoxy resin, and a graft copolymer having a main chain comprising polycarbonate and a side chain comprising a vinyl-based polymer, and also contains, as cyan dyes, Compounds I, II, and III represented by the following chemical formulas:

[Chemical Formula 1]

Compound I

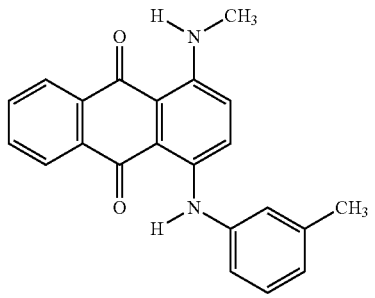

[Chemical Formula 2]

Compound II

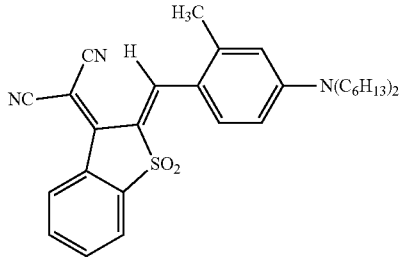

[Chemical Formula 3]

Compound III

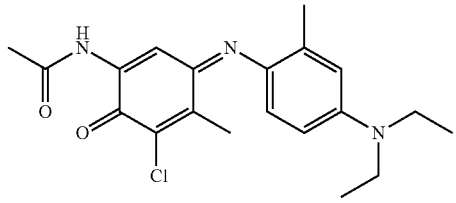

Advantageous Effects of the Invention

The thermal transfer recording medium according the present invention has improved or even high dye transfer sensitivity, and is more resistant to the occurrence of dye precipitation and scumming (i.e., having good storage stability).

BRIEF DESCRIPTION OF THE DRAWINGS

The FIGURE is a schematic cross-sectional view showing the structure of one embodiment of the thermal transfer recording medium according to the present invention.

DETAILED DESCRIPTION OF REPRESENTATIVE EMBODIMENTS

With reference to the accompanying FIGURE, a description will now be given of representative embodiments according to the present invention. The present invention is not limited to the following representative embodiments, and appropriate modifications can be made without departing from the spirit of the present invention. The representative embodiments described below are merely examples of the present invention, and the design thereof could be appropriately changed by one skilled in the art. Here, the drawings are schematic, and the relationship between thickness and plane size, the ratio of the thickness of each layer, etc., are different from actual ones. The embodiments described below are merely examples of the configurations for embodying the technical idea of the present invention, and the technical idea of the present invention should not limit the materials, shapes, structures, and the like of the components to those described below. The technical idea of the present invention can be modified in various ways within the technical scope specified by the claims.

The same constituent elements are denoted by the same reference numerals unless there is a reason for the sake of convenience, and redundant description is omitted. In the drawings referred to in the following description, for clarity, characteristic parts are enlarged, and thus the components are not shown to scale. It is, however, clear that one or more embodiments can be implemented without such details. In addition, known structures and devices may be schematically represented for simplicity.

In the thermal transfer recording medium 1 of the present embodiment shown in the FIGURE, a heat-resistant lubricating layer 40, which imparts antifriction properties to thermal heads, is laminated on a first surface (back surface) of a substrate 10, and an undercoat layer 20 and a dye layer 30 are laminated in this order on a second surface (front surface) of the substrate 10. The dye layer 30 contains, as binders, a polyvinyl acetal resin, a phenoxy resin, and a graft copolymer having a main chain comprising polycarbonate and a side chain comprising a vinyl-based polymer; and also contains Compounds I, II, and III represented by the above chemical formulas as cyan dyes.

The thermal transfer recording medium 1 of the present embodiment having such a structure has higher dye transfer sensitivity, and is resistant to the occurrence of dye precipitation and scumming (i.e., having good storage stability). That is, the thermal transfer recording medium 1 of the present embodiment has improved or even high dye transfer sensitivity, and has storage stability that can satisfy the requirements for high thermal transfer printing speed, and high density and higher quality of thermal transfer images.

The thermal transfer recording medium 1 of the present embodiment is described in more detail below.

[Substrate]

The substrate 10 is required to have heat resistance and strength to prevent softening deformation due to thermal pressure during thermal transfer. Accordingly, examples of the material of the substrate 10 include films of synthetic resins such as polyethylene terephthalate, polyethylene naphthalate, polypropylene, cellophane, acetate, polycarbonate, polysulfone, polyimide, polyvinyl alcohol, aromatic polyamide (aramid), and polystyrene; paper such as condenser paper and paraffin paper; and the like.

These materials can be used singly or as a composite of two or more. Among these, polyethylene terephthalate films are preferable in terms of physical properties, processability, cost, etc.

Moreover, the substrate 10 can be one having a thickness within a range of 2 μm or more and 50 μm or less, in terms of usability and processability. In this range, the thickness is preferably within a range of 2 μm or more and 9 μm or less, in terms of handling properties such as transferability and processability.

[Undercoat Layer]

The undercoat layer 20 can be formed mainly using a binder having good bonding properties for bonding to both the base material 10 and the dye layer 30. Examples of the binder include polyvinyl pyrrolidone-based resins, polyvinyl alcohol-based resins, polyester-based resins, polyurethane-based resins, polyacrylic-based resins, polyvinyl formal-based resins, epoxy-based resins, polyvinyl butyral-based resins, polyamide-based resins, polyether-based resins, polystyrene-based resins, styrene-acrylic copolymer-based resins, and the like.

However, when further increasing adhesion and transfer sensitivity is taken into consideration, it is preferable that the undercoat layer 20 contains a copolymer of polyester and acrylic (polyester-acrylic copolymer) and polyvinyl pyrrolidone. Further, it is preferable that the polyester-acrylic copolymer is a copolymer of polyester having a sulfonic group in a side chain, and acrylic having at least one of a glycidyl group and a carboxyl group.

The copolymerization ratio of polyester and acrylic in the undercoat layer 20 is preferably within a range of 20:80 to 40:60 by mass ratio. This is because when the amount of the polyester component is less than 20%, high printing density is obtained, but adhesion to the substrate 10 tends to be insufficient, whereas when the amount of the polyester component exceeds 40%, adhesion is improved, but the printing density tends to be reduced. Moreover, for example, the supply ratio of each polymer or monomer is the copolymerization ratio of the above copolymer. Alternatively, it is also possible to analyze the above copolymer by IR or the like, and to measure the above copolymerization ratio.

Moreover, the composition ratio of the polyester-acrylic copolymer and the polyvinyl pyrrolidone in the undercoat layer 20 is preferably within a range of 70:30 to 20:80 by mass ratio. This is because when the ratio of polyvinyl pyrrolidone is less than 30%, high printing density is less likely to be obtained, and when the ratio of polyvinyl pyrrolidone exceeds 80%, high printing density is less likely to be obtained.

The polyvinyl pyrrolidone used in the undercoat layer 20 preferably has a K value, designated by the Fikentscher formula, within a range of 30 or more and 100 or less. The K value is particularly preferably within a range of 60 or more and 90 or less. If polyvinyl pyrrolidone having a K value of less than 30 is used, the effect of improving transfer sensitivity in printing is weak, whereas if polyvinyl pyrrolidone having a K value exceeding 100 is used, the viscosity of the coating liquid increases to reduce coating suitability; thus, such polyvinyl pyrrolidone is not preferable.

The coating amount of the undercoat layer 20 after drying is not generally limited, but is preferably within a range of 0.03 $g/m^2$ or more and 0.35 $g/m^2$ or less. If the coating amount of the undercoat layer 20 after drying is less than 0.03 $g/m^2$, transfer sensitivity and adhesion during high-speed printing may be insufficient due to the deterioration of the undercoat layer 20 when the dye layer 30 is laminated. In contrast, if the coating amount of the undercoat layer 20 after drying is more than 0.35 $g/m^2$, the sensitivity of the thermal transfer recording medium 1 itself is not changed, and the printing density is saturated. Accordingly, the coating amount of the undercoat layer 20 after drying is preferably 0.35 $g/m^2$ or less, in terms of cost. The coating amount of the undercoat layer 20 after drying as mentioned herein refers to the amount of solids remaining after a coating liquid for forming the undercoat layer 20 is applied and then dried.

[Dye Layer]

The dye layer 30 is formed by, for example, preparing a coating liquid for forming the dye layer by mixing a thermal transfer dye, a binder, a solvent, etc., and applying the coating liquid, followed by drying. The coating amount of the dye layer 30 after drying is suitably about 1.0 g/m$^2$. The dye layer 30 can be formed from a single monochrome layer, or a plurality of layers containing dyes having different hues can be repeatedly formed sequentially on the same surface of the same substrate 10.

Dye layers generally maintain a disperse dye dissolved in a binder; however, the disperse dye has a thermally stable crystalline state, and thus tends to be crystallized and precipitated when stored. Therefore, in order to prevent precipitation, it is necessary that the compatibility (affinity) between the binder and the dye is high. However, thermal recording transfer theoretically transfers the dye to the transfer object side; thus, if a binder with a high compatibility with dye is selected, the dye is less likely to be transferred to the transfer object side, and the transfer sensitivity is consequently reduced. Therefore, it is not preferable that the compatibility between the binder and the dye is too high or too low.

Moreover, in terms of forming an image, a dye is selected depending on the hue and light resistance; however, as stated above, in order to obtain a thermal transfer recording medium, the affinity between the binder of the dye layer and the binder of the transfer object has to be taken into consideration; further, in order to form ink, the solubility in solvents has to be taken into consideration. In addition, in terms of cost, it is also important to select a dye with a high molar extinction coefficient, i.e., a dye with high coloring sensitivity per molecule.

The thermal transfer dye contained in the dye layer 30 is selected so that a desired hue is obtained during printing. In the present embodiment, Compounds I, II, and III represented by the above chemical formulas are essential as cyan dyes. Because these dyes have high coloring sensitivity per molecule, it is possible to improve transfer sensitivity while suppressing cost increase. The dyes that impart yellow and magenta hues are not limited. Examples of the yellow component include Solvent Yellow 56, 16, 30, 93, and 33; Disperse Yellow 201, 231, and 33; and the like. Examples of the magenta component include C.I. Disperse Red 60, C.I. Disperse Violet 26, C.I. Solvent Red 27, C.I. Disperse Red 343, C.I. Solvent Red 19, and the like.

Examples of the binder contained in the dye layer 30 include cellulose-based resins, such as ethyl cellulose, hydroxyethyl cellulose, ethylhydroxy cellulose, hydroxypropyl cellulose, methylcellulose, and cellulose acetate; vinyl-based resins, such as polyvinyl alcohol, polyvinyl acetate, polyvinyl butyral, polyvinyl acetal, polyvinyl pyrrolidone, and polyacrylamide; polyester resins, styrene-acrylonitrile copolymer resins, and the like. Of these, in order to realize a thermal transfer recording medium having higher transfer sensitivity of cyan dye during high-speed printing, and excellent storage stability, it is essential to contain a polyvinyl acetal resin, a phenoxy resin, and a graft copolymer having a main chain comprising polycarbonate and a side chain comprising a vinyl-based polymer.

Polyvinyl acetal resins refer to those obtained by partial acetalization of polyvinyl alcohol resins with butyraldehyde or acetaldehyde. Examples of polyvinyl acetal resins mainly include polyvinyl butyral resins, polyvinyl acetoacetal resins, and the like. Polyvinyl acetal resins are commercially available, and examples thereof include S-lec KS-1, KS-5, KS-10, and KS-23 (produced by Sekisui Chemical Co., Ltd.), and the like.

Phenoxy resins are high-molecular-weight polyhydroxy polyethers synthesized by the reaction of bisphenols and epichlorohydrin. Examples of the bisphenols used include bisphenol A, bisphenol B, bisphenol C, bisphenol E, bisphenol F, bisphenol G, bisphenol M, bisphenol S, bisphenol P, bisphenol Z, bisphenol AP, bisphenol AF, bisphenol BP, bisphenol PH, and bisphenol TMC, 9,9-bis(4-hydroxyphenyl)fluorene, 9,9-bis(4-hydroxy-3-methylphenyl)fluorene, and the like. Phenoxy resins are commercially available, and examples thereof include YP-50EK35, ZX-1356-II, and FX-316 (produced by Nippon Steel & Sumikin Chemical Co., Ltd.), PKHB, PKHC, and PKHH (produced by InChem, Inc.), and the like.

Polyvinyl acetal resins have relatively excellent storage stability for the Compounds I and III, but have inferior storage stability for the Compound II, and scumming is likely to occur during printing. In contrast, phenoxy resins have high storage stability for the Compound II, but have low transfer sensitivity. A polyvinyl acetal resin and a phenoxy resin are used for the dye layer 30, whereby storage stability for the Compounds I, II, and III can be obtained while transfer sensitivity is maintained.

However, there is a risk that scumming may occur when the dye layer 30 is stored for a long period of time (stored at room temperature for 180 days) or environmentally stored (at 50° C. for 4 days). That is, sufficient storage stability cannot be obtained only by mixing a polyvinyl acetal resin and a phenoxy resin. Accordingly, the dye layer 30 is allowed to further contain a graft copolymer having a main chain comprising polycarbonate and a side chain comprising a vinyl-based polymer, whereby sufficient storage stability can be obtained. This is assumed to be because the graft copolymer plays the role of improving compatibility between the polyvinyl acetal resin and the phenoxy resin.

The storage stability may not be obtained presumably for the following reason: Since the polyvinyl acetal resin and the phenoxy resin are poorly compatible with each other, the polyvinyl acetal resin and the phenoxy resin induce phase separation in the dye layer during storage, which consequently reduces the storage stability of the dye. It is considered that the storage stability of the dye can be ensured because the graft copolymer can function as a compatibilizer for the polyvinyl acetal resin and the phenoxy resin to prevent the occurrence of phase separation.

The above graft copolymer can be obtained by various known polymerization methods, such as a radical polymerization method, a cationic polymerization method, an anionic living polymerization method, a cation living polymerization method, and an ionizing radiation irradiation method, and is also easily commercially available. For example, the Modiper C series (produced by NOF Corporation) can be used.

The mixing ratio of the polyvinyl acetal resin to the phenoxy resin is preferably within a range of 90:10 to 70:30 by mass ratio. This is because when the mixing ratio of the phenoxy resin is 30% or more, the transfer sensitivity tends to be reduced. If the mixing ratio of the phenoxy resin is less than 10%, the storage stability of the Compound II tends to be reduced, which is not preferable.

Moreover, the graft copolymer sufficiently exhibits its function when it is contained in an amount of 0.5 mass % or more and 1 mass % or less in the mixture of a polyvinyl acetal resin and a phenoxy resin.

Furthermore, the dye layer 30 may contain additives, such as an isocyanate compound and a silane coupling agent, within the range that does not impair its performance.

[Heat-Resistant Lubricating Layer]

The heat-resistant lubricating layer 40 is formed by, for example, preparing a coating liquid for forming the heat-resistant lubricating layer by mixing a binder, functional additives that impart release properties and antifriction properties, a filler, a curing agent, a solvent, etc., and applying the coating liquid, followed by drying. The coating amount of the heat-resistant lubricating layer 40 after drying is suitably within a range of 0.1 $g/m^2$ or more and 2.0 $g/m^2$ or less.

Examples of the binder contained in the heat-resistant lubricating layer 40 include polyvinyl butyral resins, polyvinyl acetoacetal resins, polyester resins, vinyl chloride-vinyl acetate copolymers, polyether resins, polybutadiene resins, acrylic polyol, polyurethane acrylate, polyester acrylate, polyether acrylate, epoxy acrylate, nitrocellulose resins, cellulose acetate resins, polyamide resins, polyimide resins, polyamide-imide resins, polycarbonate resins, and the like.

Moreover, examples of the functional additives contained in the heat-resistant lubricating layer 40 include surfactants, including natural wax, such as animal wax and plant wax; synthetic wax, such as synthetic hydrocarbon wax, aliphatic alcohol and acid wax, fatty acid ester and glycerite wax, synthetic ketone wax, amine and amide wax, chlorinated hydrocarbon wax, and alpha-olefin wax; higher fatty acid esters, such as butyl stearate and ethyl oleate; higher fatty acid metal salts, such as sodium stearate, zinc stearate, calcium stearate, potassium stearate, and magnesium stearate; phosphate esters, such as long-chain alkyl phosphate ester, polyoxyalkylene alkylaryl ether phosphate esters, and polyoxyalkylene alkylether phosphate esters; and the like.

Moreover, examples of the filler contained in the heat-resistant lubricating layer 40 include talc, silica, magnesium oxide, zinc oxide, calcium carbonate, magnesium carbonate, kaolin, clay, silicone particles, polyethylene resin particles, polypropylene resin particles, polystyrene resin particles, polymethyl methacrylate resin particles, polyurethane resin particles, and the like.

Moreover, examples of the curing agent contained in the heat-resistant lubricating layer 40 include, but are not limited to, tolylene diisocyanate, triphenylmethane triisocyanate, tetramethylxylene diisocyanate, and like isocyanates, as well as derivatives thereof

[Method for Producing Thermal Transfer Recording Medium]

The heat-resistant lubricating layer 40, the undercoat layer 20, and the dye layer 30 described above can be formed by applying each layer by a general coating method, followed by drying. Examples of the method for applying each layer include a gravure coating method, a screen printing method, a spray coating method, and a reverse roll coating method.

The present invention is described in more detail below with reference to Examples and Comparative Examples; however, the present invention should not be limited to these Examples. Note that the term "part" in the following description means "part by mass," unless otherwise specified.

Example 1

<Production of Substrate with Heat-Resistant Lubricating Layer>

A 4.5-μm-thick polyethylene terephthalate film was used as a substrate 10, and a heat-resistant lubricating layer 40 was laminated on one surface of the film, thereby producing a substrate 10 with a heat-resistant lubricating layer 40. Specifically, a heat-resistant lubricating layer coating liquid having the following composition was applied to one surface of the substrate 10 by a gravure coating method so that the coating amount after drying was 1.0 $g/m^2$, followed by drying at 100° C. for 1 minute. Thereafter, aging was conducted in a 40° C. environment for one week. Thus, the substrate 10 with the heat-resistant lubricating layer 40 was obtained.

(Heat-Resistant Lubricating Layer Coating Liquid)

Acrylic polyol resin: 12.5 parts
Polyoxyalkylene alkylether/phosphate: 2.5 parts
Talc: 6.0 parts
2,6-Tolylene diisocyanate prepolymer: 4.0 parts
Toluene: 50.0 parts
Methyl ethyl ketone: 20.0 parts
Ethyl acetate: 5.0 parts <Method for Preparing Sulfonic Acid Group-Containing Polyester/Glycidyl Group-Containing Acrylic Copolymer>

In a four-necked flask equipped with a distillation tube, a nitrogen-introducing tube, a thermometer, and a stirrer, 854 parts of dimethyl terephthalate, 355 parts of 5-sodium sulfoisophthalate, 186 parts of ethylene glycol, 742 parts of diethylene glycol, and 1 part of zinc acetate as a reaction catalyst were placed.

Subsequently, they were heated from 130° C. to 170° C. over 2 hours, 1 part of antimony trioxide was added, then the temperature was raised from 170° C. to 200° C. over 2 hours, and an esterification reaction was advanced to carry out a polycondensation reaction. Thereafter, the temperature was gradually raised and the pressure was gradually reduced; finally, a polycondensation reaction was carried out for 1 to 2 hours at a reaction temperature of 250° C. at a degree of vacuum of 1 mmHg or less, thereby obtaining polyester. The obtained polyester was dissolved in pure water, then glycidyl methacrylate was added as a glycidyl group-containing acrylic monomer so that the mass ratio of the polyester to the acrylic monomer was 30:70, and potassium persulfate was further added as a polymerization initiator, thereby producing a monomer emulsion.

Subsequently, pure water and the monomer emulsion were placed in a reaction vessel equipped with a condenser tube, and nitrogen gas was blown for 20 minutes to sufficiently remove oxygen. Thereafter, the pure water and the monomer emulsion were gradually heated over 1 hour, and the reaction was performed for 3 hours while maintaining the temperature at 75° C. or more and 85° C. or less, thereby obtaining a sulfonic acid group-containing polyester/glycidyl group-containing acrylic copolymer.

An undercoat layer coating liquid having the following composition was applied to the surface of the substrate 10 with the heat-resistant lubricating layer 40, on which the heat-resistant lubricating layer 40 was not laminated, by a gravure coating method so that the coating amount after drying was 0.20 $g/m^2$, followed by drying at 100° C. for 2 minutes, thereby forming an undercoat layer 20. Further, a dye layer coating liquid-1 having the following composition was applied to the undercoat layer 20 by a gravure coating method so that the coating amount after drying was 0.70 $g/m^2$, followed by drying at 90° C. for 1 minute, thereby forming a dye layer 30. Thus, a thermal transfer recording medium of Example 1 was obtained.

(Undercoat Layer Coating Liquid)

Sulfonic acid group-containing polyester/glycidyl group-containing acrylic copolymer (30:70): 2.50 parts
Polyvinyl pyrrolidone (K value: 90): 2.50 parts Pure water: 57.0 parts
Isopropyl alcohol: 38.0 parts
(Dye Layer Coating Liquid-1)
Compound I: 3.6 parts
Compound II: 0.6 parts
Compound III: 1.8 parts
Polyvinyl acetal resin (S-lec KS-5, produced by Sekisui Chemical Co., Ltd.): 3.6 parts
Phenoxy resin (PKHH, produced by InChem Inc.): 0.4 parts
Graft copolymer (Modiper CL-430): 0.02 parts
Toluene: 40.0 parts
Methyl ethyl ketone: 40.0 parts
Tetrahydrofuran: 10.0 parts Example 2

A thermal transfer recording medium of Example 2 was obtained in the same manner as in Example 1, except that the dye layer 30 was formed using a dye layer coating liquid-2 having the following composition in place of the dye layer coating liquid-1.

(Dye Layer Coating Liquid-2)
Compound I: 3.6 parts
Compound II: 0.6 parts
Compound III: 1.8 parts
Polyvinyl acetal resin (S-lec KS-5, produced by Sekisui Chemical Co., Ltd.): 3.2 parts
Phenoxy resin (PKHH, produced by InChem Inc.): 0.8 parts
Graft copolymer (Modiper CL-430): 0.02 parts
Toluene: 40.0 parts
Methyl ethyl ketone: 40.0 parts
Tetrahydrofuran: 10.0 parts Example 3

A thermal transfer recording medium of Example 3 was obtained in the same manner as in Example 1, except that the dye layer 30 was formed using a dye layer coating liquid-3 having the following composition in place of the dye layer coating liquid-1.

(Dye Layer Coating Liquid-3)
Compound I: 3.6 parts
Compound II: 0.6 parts
Compound III: 1.8 parts
Polyvinyl acetal resin (S-lec KS-5, produced by Sekisui Chemical Co., Ltd.): 2.8 parts
Phenoxy resin (PKHH, produced by InChem Inc.): 1.2 parts
Graft copolymer (Modiper CL-430): 0.02 parts
Toluene: 40.0 parts
Methyl ethyl ketone: 40.0 parts
Tetrahydrofuran: 10.0 parts Example 4

A thermal transfer recording medium of Example 4 was obtained in the same manner as in Example 1, except that the dye layer 30 was formed using a dye layer coating liquid-4 having the following composition in place of the dye layer coating liquid-1.

(Dye Layer Coating Liquid-4)
Compound I: 3.6 parts
Compound II: 0.6 parts
Compound III: 1.8 parts
Polyvinyl acetal resin (S-lec KS-5, produced by Sekisui Chemical Co., Ltd.): 2.0 parts
Phenoxy resin (PKHH, produced by InChem Inc.): 2.0 parts
Graft copolymer (Modiper CL-430): 0.02 parts
Toluene: 40.0 parts
Methyl ethyl ketone: 40.0 parts
Tetrahydrofuran: 10.0 parts Comparative Example 1

A thermal transfer recording medium of Comparative Example 1 was obtained in the same manner as in Example 2, except that the dye layer 30 was formed by applying the dye layer coating liquid-2 mentioned above without forming an undercoat layer 20 on the surface of the substrate 10 with the heat-resistant lubricating layer 40, on which the heat-resistant lubricating layer 40 was not laminated.

Comparative Example 2

A thermal transfer recording medium of Comparative Example 2 was obtained in the same manner as in Example 1, except that the dye layer 30 was formed using a dye layer coating liquid-5 having the following composition in place of the dye layer coating liquid-1.

(Dye Layer Coating Liquid-5)
Compound I: 3.6 parts
Compound II: 0.6 parts
Compound III: 1.8 parts
Polyvinyl acetal resin (S-lec KS-5, produced by Sekisui Chemical Co., Ltd.): 3.2 parts
Phenoxy resin (PKHH, produced by InChem Inc.): 0.8 parts
Toluene: 40.0 parts
Methyl ethyl ketone: 40.0 parts
Tetrahydrofuran: 10.0 parts Comparative Example 3

A thermal transfer recording medium of Comparative Example 3 was obtained in the same manner as in Example 1, except that the dye layer 30 was formed using a dye layer coating liquid-6 having the following composition in place of the dye layer coating liquid-1.

(Dye Layer Coating Liquid-6)
Compound I: 3.6 parts
Compound II: 0.6 parts
Compound III: 1.8 parts
Polyvinyl acetal resin (S-lec KS-5, produced by Sekisui Chemical Co., Ltd.): 4.0 parts
Graft copolymer (Modiper CL-430): 0.02 parts
Toluene: 40.0 parts
Methyl ethyl ketone: 40.0 parts
Tetrahydrofuran: 10.0 parts Comparative Example 4

A thermal transfer recording medium of Comparative Example 4 was obtained in the same manner as in Example 1, except that the dye layer 30 was formed using a dye layer coating liquid-7 having the following composition in place of the dye layer coating liquid-1.

(Dye Layer Coating Liquid-7)
Compound I: 3.6 parts
Compound III: 2.4 parts
Polyvinyl acetal resin (S-lec KS-5, produced by Sekisui Chemical Co., Ltd.): 4.0
parts
Graft copolymer (Modiper CL-430): 0.02 parts
Toluene: 40.0 parts
Methyl ethyl ketone: 40.0 parts
Tetrahydrofuran: 10.0 parts Comparative Example 5

A thermal transfer recording medium of Comparative Example 5 was obtained in the same manner as in Example 1, except that the dye layer 30 was formed using a dye layer coating liquid-8 having the following composition in place of the dye layer coating liquid-1.

(Dye Layer Coating Liquid-8)
Compound I: 3.6 parts
Compound II: 0.6 parts
Compound III: 1.8 parts
Phenoxy resin (PKHH, produced by InChem Inc.): 4.0 parts
Graft copolymer (Modiper CL-430): 0.02 parts
Toluene: 40.0 parts
Methyl ethyl ketone: 40.0 parts
Tetrahydrofuran: 10.0 parts

[Printing Evaluation]

Using the thermal transfer recording media of Examples 1 to 4 and Comparative Examples 1 to 5 and a thermal simulator, solid printing was conducted on transfer objects produced in the following manner, and the maximum reflection density was evaluated. Table 1 shows the results. The maximum reflection density is a value measured by an X-Rite 528 Densitometer. Moreover, the printing conditions are as follows:

Printing environment: 23° C., 50% RH
Applied voltage: 29 V
Line cycle: 0.9 msec
Printing density: main scanning 300 dpi, sub scanning 300 dpi <Production of Transfer Object>

Art paper having a thickness of 180 g/m$^2$ was used as an image receiver substrate. A hollow particle layer coating liquid having the following composition was applied to the image receiver substrate by a gravure coating method so that the coating amount after drying was 10 g/m$^2$, followed by drying, thereby forming a hollow particle layer serving as a heat insulating layer. Thereafter, aging was conducted in a 40° C. environment for one week, thereby obtaining an image receiver with a hollow particle layer.

(Hollow Particle Layer Coating Liquid)
Foamed hollow particles containing a copolymer comprising acrylonitrile and methacrylonitrile as main components (average particle diameter: 3.2 μm, volume hollow ratio: 85%): 45 parts
Polyvinyl alcohol: 10 parts
Vinyl chloride-vinyl acetate copolymer resin dispersion (vinyl chloride/vinyl acetate=70/30, Tg: 64° C.): 45 parts
Water: 200 parts Next, a receiving layer coating liquid having the following composition was applied to the heat insulating layer on the image receiver by a gravure coating method so that the coating amount after drying was 4 g/m$^2$, followed by drying, thereby forming a receiving layer on the image receiver. Thereafter, aging was conducted in a 40° C. environment for one week, thereby obtaining an image receiver with a receiving layer.

(Receiving Layer Coating Liquid)
Vinyl chloride-vinyl acetate copolymer resin dispersion: 80 parts
(e.g., Vinyblan 900, produced by Nissin Chemical Industry Co., Ltd.)
Polyether-modified silicone: 10 parts
(e.g., KF615A, produced by Shin-Etsu Chemical Co., Ltd.)
Water: 400 parts

[Evaluation of Scumming (Storage Stability)]

The thermal transfer recording media of Examples 1 to 4 and Comparative Examples 1 to 5 immediately after production were aged at ordinary temperature for 24 hours, without being stored. Then, using the aged thermal transfer recording media and a printer (CP-D70D, produced by Mitsubishi Electric Corp.), a white solid pattern was printed on transfer objects, and the presence of cyan scumming on the print objects was examined by visual evaluation. Table 1 shows the results. In Table 1, "+" indicates that scumming was not confirmed, and "−" indicates that scumming was confirmed.

Moreover, the thermal transfer recording media of Examples 1 to 4 and Comparative Examples 1 to 5 were each stored at 50° C. for 168 hours, and stored at 40° C. at 90% for 100 hours. Next, the thermal transfer recording media after completion of storage were aged at ordinary temperature for 24 hours. Then, using the aged thermal transfer recording media and a printer (CP-D70D, produced by Mitsubishi Electric Corp.), a white solid pattern was printed on transfer objects, and the color difference (ΔE) from print objects using the unstored thermal transfer recording media was calculated. The color difference (ΔE) was calculated by the following formula:

$$\Delta E=\{(\Delta L^*)^2+(\Delta a^*)^2+(\Delta b^*)^2\}^{1/2}$$

Table 1 shows the results. A smaller difference ΔE between before and after storage indicates less dye precipitation and superior storage stability. In Table 1, "+" indicates that the color difference (ΔE) before and after storage was less than 1.0, and "−" indicates that the color difference (ΔE) before and after storage was 1.0 or more. It can be said that a color difference (ΔE) before and after storage of less than 1.0 is a level that does not cause any practical problems.

TABLE 1

| | | Cyan dye layer | | | | | | | | | | |
|---|---|---|---|---|---|---|---|---|---|---|---|---|
| | | Proportion of binder resin | | Proportion of dye | | | | | Maximum | Scumming | | |
| | Undercoat layer [g/m$^2$] | Polyvinyl aceto-acetal | Phenoxy resin | Com-pound I | Com-pound II | Com-pound III | Dye/resin ratio (DB ratio) | Grafted polymer | reflection density (255/255) | Before storage | 40° C. 90% 100 h | 50° C. 168 h |
| Example 1 | 0.2 | 90 | 10 | 60 | 10 | 30 | 1.5 | Yes | 2.49 | + | + | + |
| Example 2 | 0.2 | 80 | 20 | 60 | 10 | 30 | 1.5 | Yes | 2.49 | + | + | + |
| Example 3 | 0.2 | 70 | 30 | 60 | 10 | 30 | 1.5 | Yes | 2.49 | + | + | + |
| Example 4 | 0.2 | 50 | 50 | 60 | 10 | 30 | 1.5 | Yes | 2.35 | + | + | + |
| Comparative Example 1 | — | 80 | 20 | 60 | 10 | 30 | 1.5 | Yes | 2.00 | + | + | + |
| Comparative Example 2 | 0.2 | 80 | 20 | 60 | 10 | 30 | 1.5 | No | 2.35 | + | − | − |
| Comparative Example 3 | 0.2 | 100 | 0 | 60 | 10 | 30 | 1.5 | Yes | 2.49 | − | − | − |
| Comparative Example 4 | 0.2 | 100 | 0 | 60 | 0 | 40 | 1.5 | Yes | 2.30 | + | + | + |
| Comparative Example 5 | 0.2 | 0 | 100 | 60 | 10 | 30 | 1.5 | Yes | 2.00 | + | + | + |

As is clear from the results shown in Table 1, in Comparative Example 3, in which the dye layer did not contain a phenoxy resin, scumming was confirmed in the stage before storage, compared with Examples 1 to 4, in which the dye layer contained a phenoxy resin. Moreover, in Comparative Example 2, in which a graft copolymer was not contained, scumming was confirmed after storage, compared with Example 2, in which a graft copolymer was contained. Furthermore, it was revealed that in Example 1, in which an undercoat layer 20 was provided, the transfer sensitivity during high-speed printing was higher than Comparative Example 1, in which an undercoat layer 20 was not provided.

Here, the invention has been explained with reference to a limited number of embodiments; however, the scope of rights is not limited to these embodiments, and modifications to each of the embodiments based on the disclosure described above will be obvious to those skilled in the art.

INDUSTRIAL APPLICABILITY

The thermal transfer recording medium of the present invention can be used for sublimation transfer printers, and can easily form various images in full color, together with higher speed and higher performance of the printers. Therefore, the thermal transfer recording medium of the present invention can be widely used for self-printing of digital camera photos, cards such as identification cards, output objects for amusement, and the like.

REFERENCE SIGNS LIST

1 . . . Thermal transfer recording medium; 10 . . . Substrate; 20 . . . Undercoat layer; 30 . . . Dye layer; 40 . . . Heat-resistant lubricating layer.

What is claimed is:

1. A thermal transfer recording medium, comprising:

a heat-resistant lubricating layer laminated on a first surface of a substrate, and an undercoat layer and a dye layer laminated in this order on a second surface of the substrate, wherein the dye layer contains, as binders, a polyvinyl acetal resin, a phenoxy resin, and a graft copolymer having a main chain comprising polycarbonate and a side chain comprising a vinyl-based polymer, and also contains, as cyan dyes, Compounds I, II, and III represented by the following chemical formulas:

[Chemical Formula 1]

Compound I

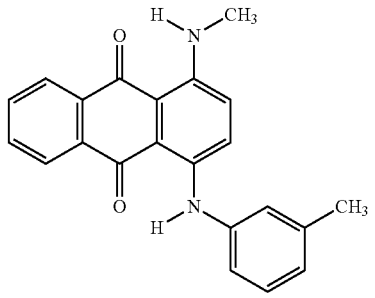

[Chemical Formula 2]

Compound II

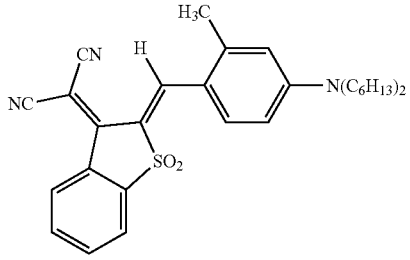

[Chemical Formula 3]

Compound III

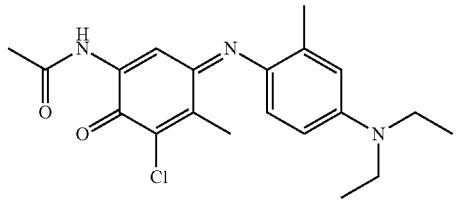

2. The thermal transfer recording medium of claim 1, wherein the undercoat layer includes a copolymer of polyester and acrylic, and polyvinyl pyrrolidone, and the copolymer of polyester and acrylic is a copolymer of polyester having a sulfonic group, and acrylic having at least one of a glycidyl group and a carboxyl group.

* * * * *